US005688023A

United States Patent [19]

Blocker, Jr.

[11] Patent Number: 5,688,023

[45] Date of Patent: Nov. 18, 1997

[54] CHAIR FRAME

[76] Inventor: Alcea Blocker, Jr., 1900 Deerfield Ct., Oxon Hill, Md. 20745

[21] Appl. No.: 596,565

[22] Filed: Feb. 5, 1996

[51] Int. Cl.[6] ..... A47C 7/62

[52] U.S. Cl. ..... 297/188.2; 297/188.04; 297/188.03

[58] Field of Search ..... 297/188.2, 188.01, 297/188.03, 188.04, 188.06, 188.08, 188.12, 135; 108/42, 49; 248/202.1

[56] References Cited

U.S. PATENT DOCUMENTS

| | | | |
|---|---|---|---|
| 125,521 | 4/1872 | Beidler | 297/188.03 |
| 1,505,829 | 8/1924 | Warnecke | 297/188.03 |
| 2,168,513 | 8/1939 | Cobb | 297/188.01 X |
| 2,703,265 | 3/1955 | Wolfe | 108/49 X |
| 3,100,128 | 8/1963 | Gleitsman et al. | 297/188.03 |
| 3,149,879 | 9/1964 | Steiber | 297/188.03 |
| 3,338,628 | 8/1967 | Evans | 297/188.2 |
| 4,506,903 | 3/1985 | Bowermaster | 297/188.2 X |
| 4,560,128 | 12/1985 | Willeby et al. | 297/188.2 X |
| 4,609,224 | 9/1986 | Coggins | 297/188.2 X |
| 4,789,200 | 12/1988 | Munguia | 297/188.2 X |
| 4,861,059 | 8/1989 | Shirk | 297/188.2 X |
| 4,861,102 | 8/1989 | Fuller | 297/188.2 X |

*Primary Examiner*—Laurie K. Cranmer

*Attorney, Agent, or Firm*—John S. Hale; Gipple & Hale

[57] ABSTRACT

A detachable tray assembly for holding personal items comprising a tray surrounded at the perimeter of its upper surface by a flange. Support arms are pivotally mounted on the tray. Adjustable clamp devices are mounted on the support arms to secure the support arms to the chair frame. Support arms may be telescopically adjustable. Clamping devices can be of a variety of types including opposing arcuate bifuricated tines and/or an adjustable collar. Clamping devices may be tightened by manually adjusting screw-type fasteners. The tray assembly is easily moved between chairs of varying sizes without the use of tools.

10 Claims, 3 Drawing Sheets

CHAIR FRAME

BACKGROUND OF THE INVENTION

1. Field of the Invention

This invention is generally directed to shelves or trays located under the seats of chairs to hold a variety of objects. More specifically, the invention is directed to a detachable tray which attaches to the front legs of a folding chair and is located below the seat when in use. This invention is also directed to a detachable towel rack for use with a folding or non-folding chair.

The idea of placing a shelf under a chair is not new in the art. Indeed, shelves have been placed under chair seats for several decades. Although shelves have been placed under chair seats in various positions and for various purposes, no folding chairs are available which have trays located under the chairs when the chairs are in use.

A need exists, therefore, for a detachable tray that can be quickly mounted to a folding chair with or without the use of tools.

The general idea of placing a rack for holding objects on the back of a chair seat is also not new in the art. The idea of placing a detachable rack on the back of a seat, especially a folding chair seat is novel.

The present invention is a detachable shelf assembly with a tray portion having clamping devices mounted on it to provide for attachment to the chair. Adjustable support arms are present in some embodiments of the invention to allow the device to be attached to folding chairs of various dimensions. Adjustable clamping devices on the support arms allow the support arms to be clamped to chair legs having various shapes and dimensions. The support arms are telescopic in some embodiments to allow attachment to chairs of various widths. Pivotal connections between the support arms and the tray portion of the shelf allow the tray to be leveled after the support arms are attached to the chair legs. The shelf can be constructed from a variety of materials, including plastic and other flexible and resilient material to allow the shelf to be used in environments such as sports arenas where it may be subjected to moderate impacts. The flexible and resilient materials allow the shelf to remain level on the chair and not be damaged.

2. History of the Related Art

It is well-known that shelves attached to chairs can be used for a variety of purposes. A shelf attached to a chair can be used to hold a variety of objects or to support the feet of the person sitting in the chair. Frequently a person using a chair will hold one or several objects which he or she is using with the desire to set them down when not in use. The shelves available for this purpose are of several types and each has certain limitations.

U.S. Pat. No. 2,755,845 to Robin discloses a circular tray mounted on a support member which is pivotally attached to the underside of the chair seat. The tray swings out from under the seat where it is stored and is therefore at the side of and approximately at the level of the chair seat when in use. The tray is not usable when it is under the seat. This tray is not advantageous when chairs are placed closely together in rows.

U.S. Pat. No. 5,452,950 to Crenshaw et al. shows a combination desktop and computer located above and in front of the chair seat. The desktop is supported by an arm which is attached to the chair frame at one side of the seat. A book rack which is essentially a wire cage-like shelf is located beneath the seat and accessible from behind the chair only. The book rack is suitable only for holding large objects is attached to the chair in two places: at the front of the rear chair legs and at the lateral frame support for the chair seat.

U.S. Pat. No. 4,844,537 to Reed shows a high chair with a detachable table surface and with detachable legs. The detachable legs have a foot rest assembly attached to them. The foot rest comprises a platform hingedly connected to two support arms mounted on the front legs. The table portion of the high chair is removable and the horizontal supports used to hold the tray can then be used to attach the chair to a regular table after the legs of the chair have been detached.

U.S. Pat. No. 1,248,138 to Larson discloses a deck chair with a solid shelf-like member that is moveable between two positions. In the first position, the shelf member is substantially co-planar with the top surface of the seat to form a leg rest for sitting with one's legs straight. When the shelf member is in this position one end of the shelf member is supported by hinges on the front edge of the seat, and the opposite end is supported by short, folding legs. In the second position, the shelf member swings upward to form a table surface above and in front of the seat.

U.S. Pat. No. 177,922 to Osborn is directed toward a combined chair and wardrobe. FIGS. 1,2, and 5 show a U-shaped bar attached to the vertical supports of the chair back forming a towel rack on the back of the chair. This patent also shows a series of horizontal supports under the seat which form a shelf for holding objects.

U.S. Pat. No. 5,415,457 to Kifer discloses an attachment on the back of a vehicle seat for supporting various items. The device comprises a series of hooks for supporting items which have handles, such as plastic grocery bags or purses. A rigid back wall is first mounted to the back of the seat. A subassembly is attached to the rigid back wall through a series of flanges and U-shaped openings are cut into the subassembly to serve as hooks.

U.S. Pat. No. 462,723 to Morss is for a shelf on the back of a railway car for holding packages. The shelf folds up when not in use. The angle the shelf forms with the seat back can be changed to accommodate the various positions the seat back may be in.

None of the cited prior art discloses a detachable, under-seat tray assembly for use with folding chairs of various dimensions which is out of the way of the person in the chair and out of the way of other people when used in a crowded environment such as an athletic arena, assembly hall or meeting room.

SUMMARY OF THE INVENTION

This invention is directed to a detachable and durable tray assembly and a detachable towel rack adapted to be used with folding chairs of various dimensions. The shelf is designed to be easily attachable to and removable from folding chairs of the type used in professional and non-professional sports arenas, assembly halls and meeting rooms.

The shelf attaches quickly and securely to the frame of the chair beneath the seat. Attachment and removal may be accomplished by hand-manipulated fasteners without the use of tools. Support arms may be mounted on the tray portion of the shelf assembly in some embodiments of the invention. The shelf is easily made level once the support arms are attached to the chair legs. The support arms mounted on the tray may be telescopic so that they can be longitudinally extended to allow attachment of the shelf to chairs of various widths. Adjustable clamping devices may be constructed to accommodate chair legs of various shapes and dimensions.

If support arms are included in the embodiment of the tray assembly, the support arms can be secured to the chair frame in a number of ways. In one version opposing arcuate tines made of a flexible material could be used to secure one or more of the support arms to the chair. The opening between the tines would be placed against the chair leg at the point of attachment and then pressure would be applied to the support arm, separating the tines and forcing the chair leg between them. The tines would then return toward their original positions, clamping the chair leg between them.

Other means for attaching the support arm to the chair leg include opposing arcuate tines which are adjustable by a hand-manipulated fastener or an adjustable collar, which also may be adjustable by hand-manipulated fasteners.

The detachable towel rack is designed to be easily and securely attached to and removed from the back of a chair seat. The detachable towel rack can be used with any type of chair.

It is an object of the present invention to provide a detachable tray assembly and a detachable towel rack which can be easily transported and quickly attached to a folding chair.

It is another object of this invention to provide the user with a tray that is located under the seat of the chair while in use in a position that is readily accessible to the user.

It is a further object of the present invention to provide the user with a durable and light weight tray that can withstand rough handling without damage during transport and can withstand impact while in place on the chair without becoming detached from the chair or becoming unlevel.

It is a further object of the present invention to provide a tray which is attachable to and detachable from a chair quickly without the use of tools.

It is a further object of the present invention to provide a towel rack which is attachable to and detachable from a chair quickly without the use of tools.

In the accompanying drawings, there is shown illustrative embodiments of the invention from which these and other objective, novel features and advantages will be readily apparent.

DETAILED DESCRIPTION OF THE DRAWINGS

Figure 12:
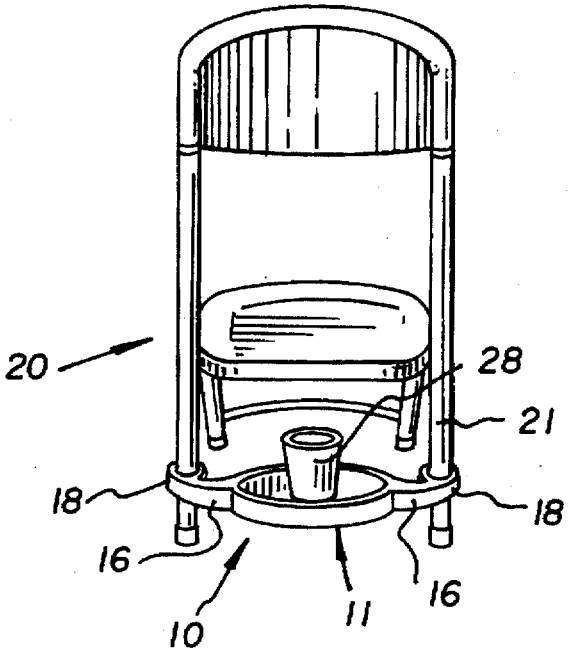
FIG. 12 is a front view of a folding chair with the tray assembly attached.
Figure 14:
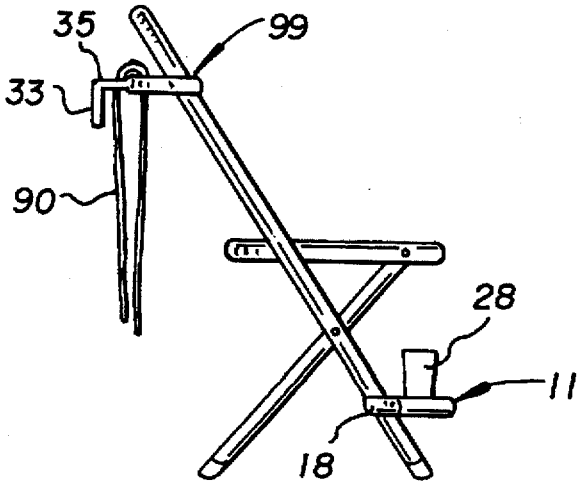
FIG. 14 is a side view of a folding chair with the cup holder of FIG. 13 and towel rack of FIG. 12 attached.

The chair tray assembly of the present invention has been designed to provide an easily assembled tray which can be used on folding chairs and the like during sporting events such as basketball or for assemblies, conventions, entertainment and the like. The detachable towel rack of the present invention is similarly designed to provide an easily and securely attachable towel rack for use with chairs of various types. The preferred embodiment and best mode of the invention is shown in FIGS. 12 and 14.

Figure 1:
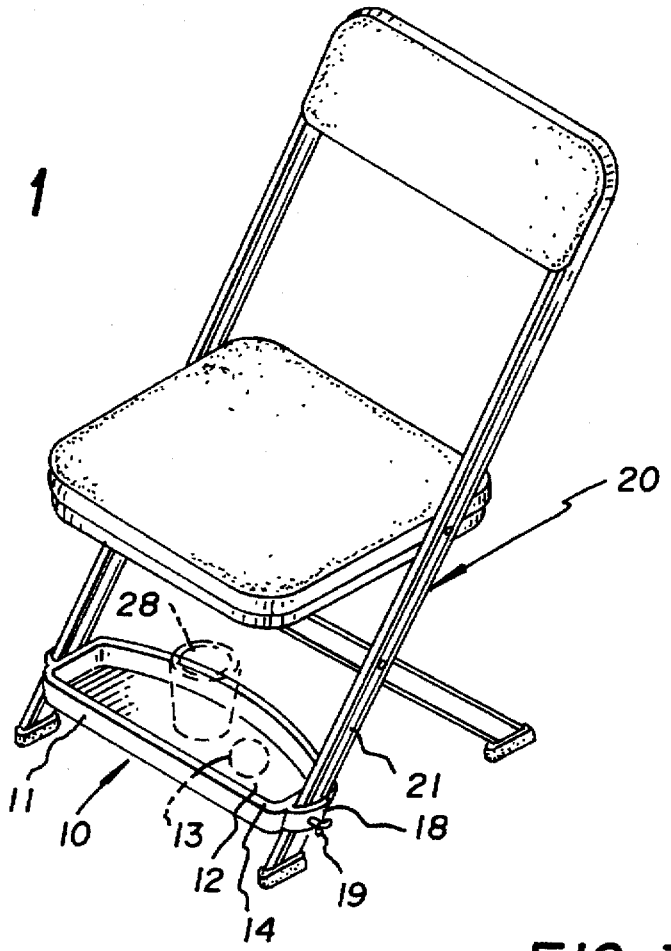
FIG. 1 is a perspective view of a tray assembly attached to a folding chair.
Figure 6:
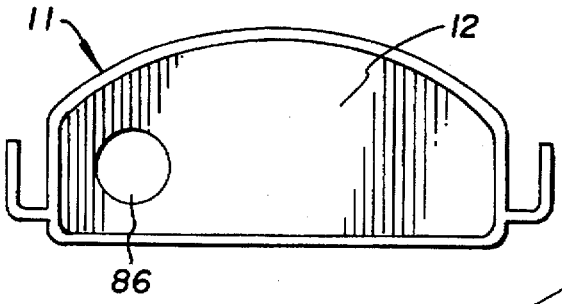
FIG. 6 is a plan view of a tray showing a circular hole cut in the tray surface to hold a drinking glass or beverage bottle.

Referring more particularly to the drawings by characters of reference, FIG. 1 shows a perspective drawing of a folding chair with a tray assembly 10 attached. Although the tray assembly 10 is shown in the drawing in use only with a folding chair, these representations are not intended to be limiting. The removable tray assembly can be used with many types of chairs, both folding and nonfolding. The tray assembly 10 includes a tray portion 11 having planar surface 12 and flange 14. The planar surface 12 has a circular depression or recess 13 formed therein which can hold a drink cup or bottle so that the same does not move across the planar surface. Flange 14 prevents objects like cup 28 which are placed on the planar surface 12 from sliding off. The tray portion 11 is provided with clamping devices 18. The planar surface 11 can also be provided with a cut out 86 as shown in FIG. 6 to hold a cup or container in a fixed position. The clamping devices 18 are used to secure the tray 11 to the chair frame 20 or legs 21. Clamping device 18 is provided with a hand adjustable fastener 19. Hand adjustable fastener 19 is threadably engaged with clamping device 18 to secure clamping device 18 to chair frame 20.

Figure 2:
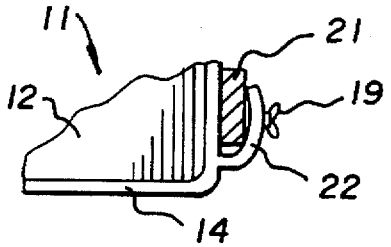
FIG. 2 is a partial view of an embodiment of an adjustable clamp comprising a yoke that is threadably adapted to receive a winged screw-type fastener.

FIG. 2 shows one embodiment of the clamping device 18 used to secure the tray assembly to chair frame 20. A one-sided clamping device 22 is shown attached to chair leg 21. The one-sided clamp 22 is provided with a hand adjustable fastener 19 which is threadably engaged with one-sided clamping device 22 and is threaded until it engages the chair leg holding the tray assembly firmly in place. While the clamp 22 is shown holding a rectangular leg it can be modified to hold a round leg of the chair by curving the inner holding surface.

Figure 3:
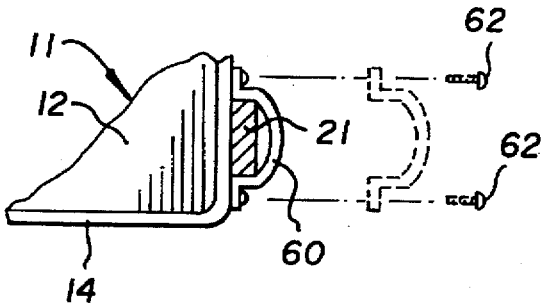
FIG. 3 is a partial view of another embodiment of an adjustable clamp comprising a detachable fastener threadably adapted to receive screw-type hand manipulated fasteners.

FIG. 3 shows another embodiment of the clamping device. Detachable clamp 60 is secured to tray 11 by means of threaded fasteners 62. Threaded fasteners 62 are tightened until tray 11 is securely attached to chair leg 21.

Figure 4:
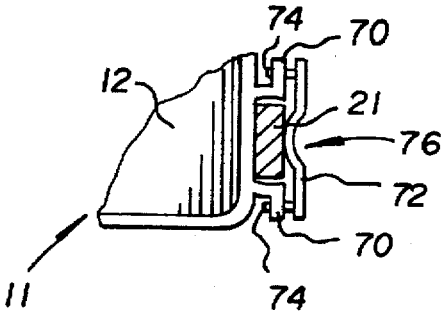
FIG. 4 is a partial view of yet another embodiment of an adjustable clamp comprising a channel on the tray adapted to receive a detachable locking member.

FIG. 4 shows another embodiment of the clamping device. In this embodiment brackets 70 are attached to tray 11. Chair leg 21 is placed between brackets 70. Detachable bracket clamp 72 is secured to brackets 70 by means of bracket fasteners 74. Bracket clamp 72 is provided with an arcuate portion 76 which cams the chair leg 21 between clamp 72 and tray 11.

Figure 5:
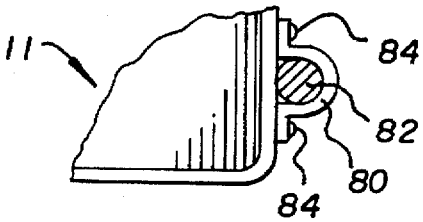
FIG. 5 is a partial view of an embodiment as shown in FIG. 3 adapted to fit on a tubular chair leg.

FIG. 5 shows yet another alternative embodiment of the detachable clamp shown in FIG. 3. In this figure a detachable round-bottomed clamp is shown secured to tray 11 by fasteners 84. A cylindrical portion of a chair frame 82 is shown between round-bottomed clamp 80 and tray 12.

The top view of tray 11 is shown with a circular opening 86 cut in the planar surface 12. Circular opening 86 is configured to accommodate the lower portion of a tapered paper cup or water bottle. The lower portion of the cup protrudes beneath the bottom of the tray when the cup is in place.

While a number of clamping devices have been disclosed, the preferred embodiment of the clamping device 18 is shown in FIG. 12. In this embodiment a clamping device 18 would be formed by mounting a pair of opposing bifurcated arcuate tines on support arm 16. Attachment of the support arm 16 to chair leg 21 is accomplished by placing the chair leg 21 in the opening between the tines and then camming the support arm 16 until the chair leg 21 is contained between the arcuate tines. Frictional force between tines and the chair frame 20 hold the support arm 16 in a fixed position.

In an another embodiment of the tray assembly 10 adjustable support arms 16 are provided with clamping devices 18. The clamping devices 18 are used to secure the tray assembly 10 to chair leg 21.

Figure 15:
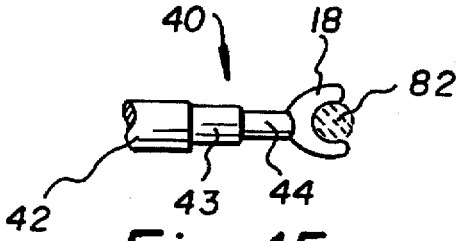
FIG. 15 is an enlargement of a telescoping support arm which can be used with the tray assembly.

FIG. 15 shows an adjustable support arm 40 constructed using a telescoping mechanism allowing the adjustable support arm 40 to be longitudinally shortened and lengthened. Adjustable support arm 40 is provided with an upper sleeve 42, a middle sleeve 43 and a lower sleeve 44. Upper sleeve 42 surrounds middle sleeve 43 and middle sleeve 43 surrounds lower sleeve 44. Upper sleeve 42 is pivotally connected to tray 11. Clamp 18 is mounted on lower sleeve 44 allowing attachment of the cup holder 10 to the chair frame 82.

Although not shown in the drawings, it is contemplated that in one embodiment the support arms 16 are pivotally connected to the tray 11 allowing maximum freedom of movement of the adjustable support arms 16 relative to the tray 11, thus enabling the cup holder 10 to be attached to chair frames of various dimensions.

It is contemplated that a variety of different materials being used to construct the tray assembly 10. Preferably, a lightweight, durable and flexible material would be used such as a plastic or a composite material for the tray portion and adjustable clamps.

Figure 7:
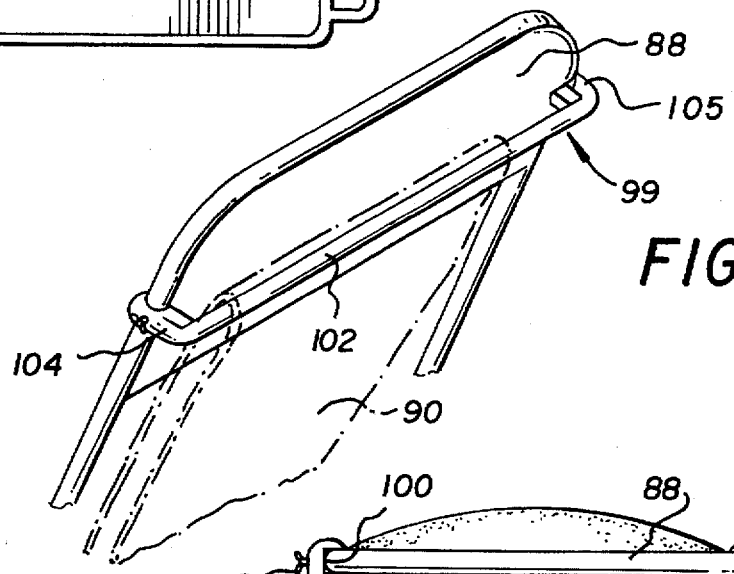
FIG. 7 is a perspective partial view of the back of a folding chair showing the removable towel rack attached with the towel shown in phantom.
Figure 8:
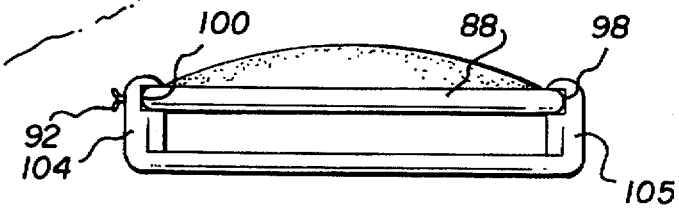
FIG. 8 is a top plan view of an adjustable fastener used to secure the towel rack to the chair back.

FIGS. 7 and 8 show an embodiment of a towel rack attached to a chair back 88 and supporting towel 90. The towel rack consists of a towel bar 102 supported by towel bar arms 104 and 105 attached to each end. Towel bar arm 105 is provided with towel bar arm notch 98. Chairback 88 is placed in arm notch 98 to secure one side of towel rack to the folding chair. Towel bar arm 104 is provided with a threaded arm notch 100. Threaded notch 100 is accommodated with a correspondingly threaded winged fastener 92. The towel rack assembly is placed over the chair back 88 so that the chair back 88 is enclosed within towel bar arm notch 98 and threaded arm notch 100. Winged fastener 92 is tightened so that the seat back 88 is securely cammed between notches 98 and 100.

Figure 9:
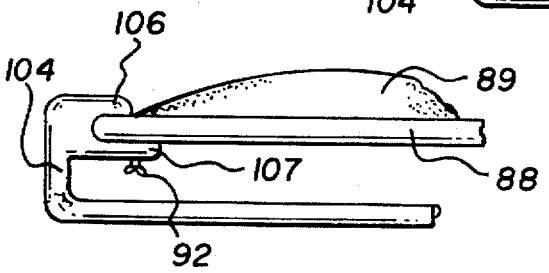
FIG. 9 is a partial top plan view of a chair back showing a towel rack attached.

FIG. 9 shows an alternative embodiment of the towel bar arm with a threaded notch. In this embodiment the towel bar arm 104 is provided with opposing seat grasping members 106 and 107. Grasping member 106 is truncated to be co-extensive with the chair frame and not to overlap the seat cushion 89. Opposing grasping member 107 is elongated to accommodate a threaded bore which extends through its width. Correspondingly threaded winged fastener 92 extends through the threaded bore to secure towel bar arm to chair back 88.

Figure 10:
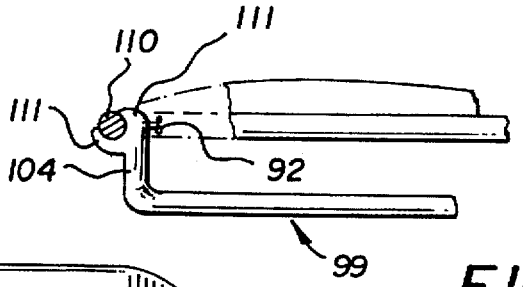
FIG. 10 is a partial plan view of a chair back showing a towel rack attached.

FIG. 10 shows an alternative means of securing towel bar arm 104 to a folding chair. In this embodiment the towel bar arm 104 terminates with a pair of opposing bifurcated prongs 111 which are used to secure towel bar arm 104 to cylindrical seat post 110. When the towel rack assembly 99 is in place on the cylindrical seat partition 110, the support arm cams the prongs 111 against seat post 110 to hold rack assembly in place. Adjustable winged fastener 92 is then tightened to secure the towel rack 99 to the chair.

Figure 11:
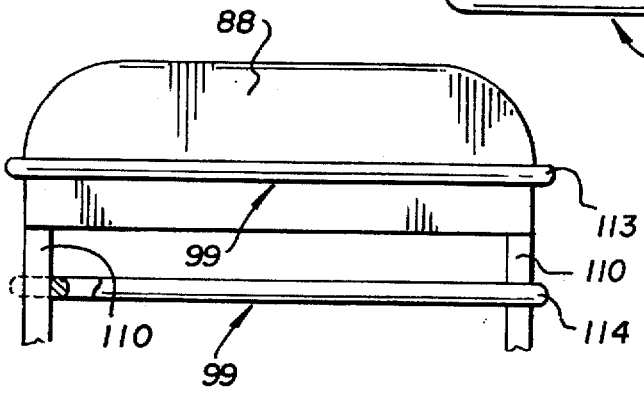
FIG. 11 is a partial rear elevational view of the back of a folding chair showing two towel racks attached, an upper towel rack attached to the seatback portion of the folding chair and a lower towel rack attached to the vertical supports for the seat back.

FIG. 11 shows a partial view of a seat back with two alternative placements of the rack assembly. The rack assembly can be attached to the seat back in some embodiments as shown by the rack labeled 113 or the rack assembly can be attached to the seat posts 110 as is the rack labeled 114.

Other clamping devices which are envisioned by the inventor are not shown in the drawings, but they include clamping devices using tines or an adjustable collar which are held in place through the use of hand adjustable fastening elements. Cup holder 10 is designed to be easily attachable to and detachable from a chair without the use of tools.

Figure 13:
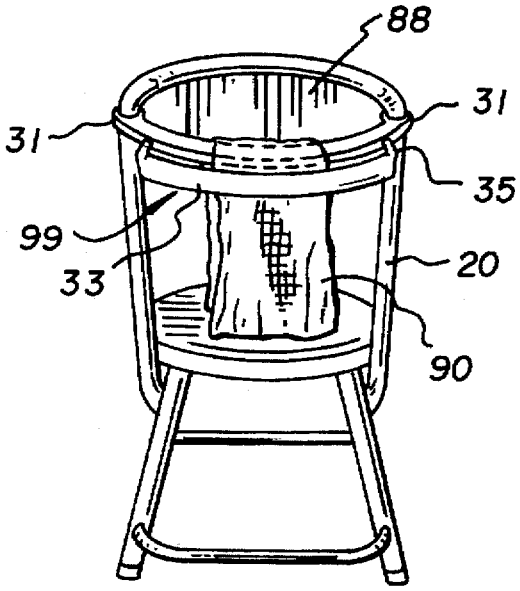
FIG. 13 is a rear view of a folding chair showing the towel rack attached.

A towel rack 30 with an advertising plate 33 is shown in FIGS. 13 and 14. Towel rack 30 is a U-shaped rod having opposing fasteners 31 at each end. Fasteners 32 are used to secure towel rack 30 to seat back 34. Towel rack 30 can be used to store towels, jerseys and other articles of clothing. An advertising plate 33 is mounted to the towel rack by arms 35 so that a towel hangs between the advertising plate 33 and the towel rack U-shaped rod. The towel 90 is shown for purposes of illustration although in the normal embodiment it cannot be seen.

In the foregoing description, the invention has been described with reference to a particular preferred embodiment, although it is to be understood that specific details shown are merely illustrative, and the invention may be carried out in other ways without departing from the true spirit and scope of the following claims.

What I claim is:

1. A detachable towel rack for a folding chair comprising a towel bar and means for removably affixing the towel bar to the back of a chair to hang towels and articles of clothing therefrom, said towel bar further comprising a plurality of support arms attached to said towel bar, and including a first support arm and a second support arm, the first support arm being attached to the first end of the towel bar and the second support arm being attached to the second end of the towel bar, and an advertising plate mounted to and spaced from said towel bar to define an opening therebetween.

2. A detachable towel rack for a folding chair as claimed in claim 1 wherein the means for removably affixing the towel bar comprises a plurality of hand manipulate fasteners.

3. A detachable towel rack for a folding chair comprising a towel bar to hang towels and articles of clothing therefrom, a plurality of support arms secured to said towel bar including a first support arm and a second support arm, said first support arm being secured to the first end of said towel bar and said second support arm being secured to the second end of said towel bar, each support arm being provided with a notch at an end distal to said towel bar to receive the back of a folding chair and threaded fastener means, the threaded fastener means being positioned to secure the detachable towel rack to the back of the chair when the back of the chair is located in the first and second notches; and an advertising plate mounted to said towel rack.

4. A detachable towel rack for a folding chair comprising a towel bar to hang towels and articles of clothing therefrom, a plurality of support arms secured to said towel bar, including a first support arm and a second support arm, the first support arm being attached to the first end of the towel bar and the second support arm being attached to the second end of the towel bar, said first support arm is provided with a first pair of opposing arcuate prongs and the second support arm is provided with a second pair of opposing arcuate prongs and each pair of opposing arcuate prongs is provided with a threaded aperture and each threaded aperture is provided with a threaded fastener, the first and second pairs of prongs being positioned to receive the vertical supports of the back of the seat of the folding chair therein and secure said towel bar to said chair when said threaded fasteners are tightened; and an advertising plate mounted to said towel rack and spaced from said towel bar.

5. A detachable towel rack for a folding chair comprising a towel bar to hang towels and articles of clothing therefrom, a plurality of support arms secured to said towel bar, including a first support arm and a second support arm, one support arm is provided with a first pair of parallel flanges and a second support arm is provided with a second pair of parallel flanges, said first and second pairs of flanges being positioned to receive the back of the folding chair, the first and second pairs of flanges being provided with threaded fasteners to secure the towel rack to the chair; and an advertising plate mounted to and spaced from said towel bar to define an opening therebetween.

6. A detachable towel rack for a folding chair comprising:

a towel bar having a first end and a second end;

a plurality of support arms including a first support arm and a second support arm secured to said towel bar;

a plurality of deformable resilient opposing arcuate prongs including a first pair of resilient opposing arcuate prongs and a second pair of resilient opposing arcuate prongs mounted to said support arms wherein the proximal end of the first support arm is provided with the first pair of resilient opposing arcuate prongs and the proximal end of the second support arm is provided with the second pair of resilient opposing arcuate prongs and wherein each pair of resilient opposing arcuate prongs is positioned to receive a vertical support of said folding chair and to hold said towel bar to said chair by causing each of the prong members to resiliently open, receive, and hold a vertical support of said chair within each pair of prongs;

and an advertising plate mounted to said arms and spaced from said towel bar to define an opening therebetween.

7. A detachable towel rack for a folding chair comprising:

a back plate assembly having a first end edge and a second end edge; said back plate assembly being provided with a surface which will support a printed advertising message;

a plurality of support members secured to the respective ends of said back plate assembly, each support member being provided with removable fastening means which can be mounted on a folding chair;

a towel bar having a first end and a second end, said first end of said towel bar and said second end of said towel bar are mounted to said back plate assembly so that said towel bar is positioned between said back plate assembly and said folding chair when the detachable towel rack is secured to said folding chair to receive a towel or articles.

8. A detachable towel rack for a folding chair as claimed in claim 7 wherein said means for securing the proximal end of each support member to a folding chair comprises a plurality of pairs of resiliently deformable opposing arcuate prongs, allowing a vertical support of the folding chair to be pressed between a pair of prongs to detachably secure said towel rack to said folding chair.

9. A detachable towel rack for a folding chair as claimed in claim 7 wherein said back plate assembly has a top edge which extends from said first end edge to said second end edge and a bottom edge which extends from said first end edge to said second end edge and wherein said back plate assembly surface curves outwardly away from said folding chair such that said top and bottom edges are curved and said first and second end edges are substantially straight.

10. A detachable towel rack for a folding chair as claimed in claim 7 wherein said back plate assembly can be selectively attached or removed from said folding chair.

* * * * *